US007922041B2

(12) United States Patent
Gurrisi et al.

(10) Patent No.: US 7,922,041 B2
(45) Date of Patent: Apr. 12, 2011

(54) SPRAY DISPENSERS

(75) Inventors: Paul Gurrisi, Kingston, NH (US); Timothy Collin Wheatley, Beverly, MA (US); Steve Schennum, Plainfield, IL (US); Jeremy Abel, Roselle, IL (US); Ng Man Kin Ricky, Tseung Kwan O (HK); Thomas Carsello, Bartlett, IL (US)

(73) Assignee: The Procter & Gamble Company, Cincinnati, OH (US)

( * ) Notice: Subject to any disclaimer, the term of this patent is extended or adjusted under 35 U.S.C. 154(b) by 941 days.

(21) Appl. No.: 11/643,576

(22) Filed: Dec. 21, 2006

(65) Prior Publication Data

US 2007/0241134 A1 Oct. 18, 2007

Related U.S. Application Data

(60) Provisional application No. 60/754,797, filed on Dec. 29, 2005, provisional application No. 60/758,383, filed on Jan. 11, 2006.

(51) Int. Cl.
*B67B 1/00* (2006.01)

(52) U.S. Cl. ..... 222/153.11; 222/154; 222/183; 222/325

(58) Field of Classification Search ..... 222/182, 222/183, 325, 402.1, 402.11, 153.11, 153.13, 222/154; 220/326, 625, 916, 835
See application file for complete search history.

(56) References Cited

U.S. PATENT DOCUMENTS

| | | | | | |
|---|---|---|---|---|---|
| 3,157,317 | A | * | 11/1964 | Ramsbotham | 222/183 |
| 3,347,423 | A | * | 10/1967 | Babbin et al. | 222/183 |
| 3,828,982 | A | * | 8/1974 | Steigerwald | 222/153.11 |
| 4,024,988 | A | * | 5/1977 | Starrett | 222/153.11 |
| 4,079,862 | A | * | 3/1978 | Fegley | 222/162 |
| 4,955,567 | A | * | 9/1990 | Longhurst | 248/108 |
| 5,242,349 | A | * | 9/1993 | Reiff et al. | 482/106 |
| 5,348,193 | A | * | 9/1994 | Bruckner et al. | 222/175 |
| 5,358,101 | A | * | 10/1994 | Lombardi | 206/776 |
| 5,366,118 | A | * | 11/1994 | Ciammitti et al. | 222/153.1 |
| 5,460,288 | A | * | 10/1995 | Balzeau | 220/326 |
| 5,531,359 | A | | 7/1996 | Winner | |
| 5,858,343 | A | * | 1/1999 | Szymczak | 424/73 |
| 5,949,338 | A | * | 9/1999 | Masi et al. | 340/573.1 |
| 6,016,916 | A | * | 1/2000 | Ortner | 206/581 |
| 6,056,160 | A | * | 5/2000 | Carlucci et al. | 222/146.3 |
| 6,269,821 | B1 | | 8/2001 | Berke et al. | |
| 6,830,164 | B2 | * | 12/2004 | Michaels et al. | 222/402.1 |
| 2002/0074349 | A1 | | 6/2002 | Michaels et al. | |

FOREIGN PATENT DOCUMENTS

| | | | |
|---|---|---|---|
| FR | 2335420 | A1 | 7/1977 |
| FR | 2705322 | A1 | 11/1994 |
| WO | WO 00/68633 | A1 | 11/2000 |

OTHER PUBLICATIONS

International Search Report, PCT/182006/004321, Dated Oct. 4, 2010.

* cited by examiner

*Primary Examiner* — Kenneth Bomberg
*Assistant Examiner* — Daniel R Shearer
(74) *Attorney, Agent, or Firm* — Mark A. Charles; Andrew J. Hagerty

(57) ABSTRACT

Spray dispensers and body spray systems are provided. The spray dispensers are suitable for use with aerosol personal care compositions, e.g., body sprays, and are configured to allow removal and replacement of an aerosol spray canister. In some implementations, the spray dispensers include an actuator lock.

12 Claims, 21 Drawing Sheets

SPRAY DISPENSERS

CROSS REFERENCE TO RELATED APPLICATIONS

This application claims the benefit of U.S. Provisional Application No. 60/754,797 filed on Dec. 29, 2005 and U.S. Provisional Application No. 60/758,383 filed on Jan. 11, 2006.

FIELD OF THE INVENTION

This invention relates to spray dispensers, and more particularly to aerosol spray dispensers for personal care products.

BACKGROUND OF THE INVENTION

Spray dispensers containing personal care products that are applied topically are often referred to as "body sprays." These body sprays may be used to spray individual selected areas of the body, such as the underarm or foot, or may be used to spray large areas of the body. Such body sprays are generally portable, and include an aerosol canister fitted with an actuator mechanism and spray nozzle at the top of the canister that the user operates to apply the product to the user's skin. The personal care product may include a wide variety of cosmetic and/or skin care ingredients including, for example, fragrances, deodorant agents, antiperspirant agents, botanicals, and moisturizers.

SUMMARY OF THE INVENTION

In one embodiment, the present invention features a spray dispenser for an aerosol personal care composition, including: (a) a housing having an upper end, a bottom end and a sidewall, wherein the housing defines an interior compartment for holding a replaceable aerosol canister and has a bottom opening at the bottom end dimensioned to receive the replaceable aerosol canister; (b) a spray actuator assembly mounted at the upper end of the housing, wherein said spray actuator assembly comprises a spray nozzle and a manually depressible actuator button; (c) a closure mounted to the bottom opening of the housing, wherein the closure is openable and closable, thereby permitting insertion, retention and removal of the replaceable aerosol canister within or from the housing; and (d) a viewing window in the sidewall of the housing to permit a user to view a marking on the replaceable aerosol canister.

In another embodiment, the present invention features a spray dispenser for an aerosol personal care composition, including: (a) a housing having an upper end, a bottom end and a sidewall, wherein the housing defines an interior compartment for holding a replaceable aerosol canister and has a bottom opening at the bottom end dimensioned to receive the replaceable aerosol canister; (b) a spray actuator assembly mounted at the upper end of the housing, wherein said spray actuator assembly comprises a spray nozzle and a manually depressible actuator button; (c) a closure mounted to the bottom opening of the housing by a hinge, wherein the closure is pivotable about the hinge between open and closed positions, thereby permitting insertion, retention and removal of the replaceable aerosol canister within or from the housing, the closure including an internally facing surface and an externally facing surface; and (d) a latch mechanism configured to maintain the closure in its closed position, the latch mechanism comprising a latch portion configured to engage a region of the housing defining the bottom opening, a latch actuator positioned to allow a user to move the latch portion out of engagement with the housing, and a spring mechanism configured to bias the latch portion toward its engaged position.

The present invention also features a spray dispenser for an aerosol personal care composition, including: (a) a housing having an upper end, a bottom end and a sidewall, wherein the housing defines an interior compartment for holding a replaceable aerosol canister and has a bottom opening at the bottom end dimensioned to receive the replaceable aerosol canister; (b) a spray actuator assembly mounted at the upper end of the housing, the spray actuator assembly including a spray nozzle, a manually depressible actuator button, and an actuator lock configured to prevent accidental actuation, the actuator lock being movable between a locked position and an unlocked position by radial movement of a locking member; and (c) a closure mounted to the bottom opening of the housing by a hinge, movable between open and closed positions, thereby permitting insertion, retention and removal of the replaceable aerosol canister within or from the housing.

In yet another embodiment, the present invention includes a body spray system or product line that comprises a plurality (i.e., two or more, preferably three to ten) of replaceable body spray aerosol canisters that have different contents, such as, for example, different fragrances and/or performance or aesthetic characteristics (e.g., deodorant, moisturizing, freshening, soothing, earthy, citrus, floral, musk, etc.) and/or different external markings (e.g., words, colors, designs, etc.) on the canisters. The plurality of different replaceable body spray aerosol canisters may be packaged together or separately. However, where separately packaged, the plurality of different canisters will preferably be displayed at a retail establishment adjacent each other. The term adjacent, as used herein to describe retail placement, means within about 30 cm, preferably within about 15 cm, most preferably within about 10 cm. In a further embodiment, the body spray system includes a reusable spray dispenser and a plurality of replaceable body spray aerosol canisters as described above. It is preferred that the reusable spray dispenser will be packaged with at least one of the replaceable aerosol canisters, and typically with a plurality of replaceable aerosol canisters. It is preferred that the reusable spray dispenser (optionally including any aerosol canister packaged with it) will be displayed at a retail establishment adjacent (as previously defined) a plurality of different replaceable body spray aerosol canisters.

The spray dispensers discussed herein may exhibit one or more of the following advantages. Preferred dispensers are compact and portable, and generally aesthetically pleasing. Some dispensers are configured to allow cartridges to be easily removed and replaced by the consumer. In some implementations, the consumer can easily view which type of cartridge is contained in the dispenser housing. The dispenser may, in some cases, include an actuator lock to prevent inadvertent actuation, for example when the dispenser is in a pocket, sportsbag or backpack.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION OF THE INVENTION

Figure 1:
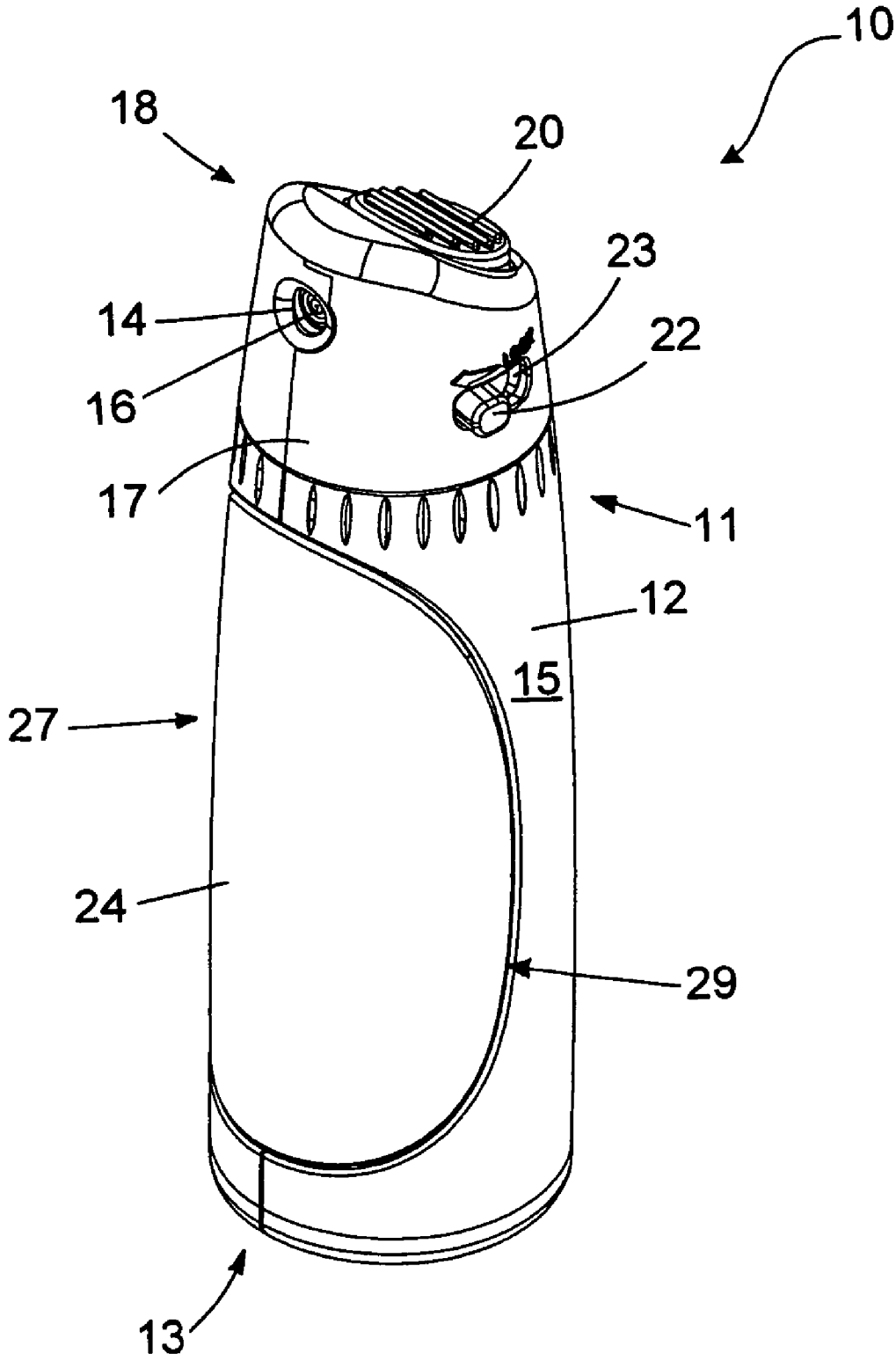
FIG. 1 is a perspective view of a dispenser.
Figure 3:
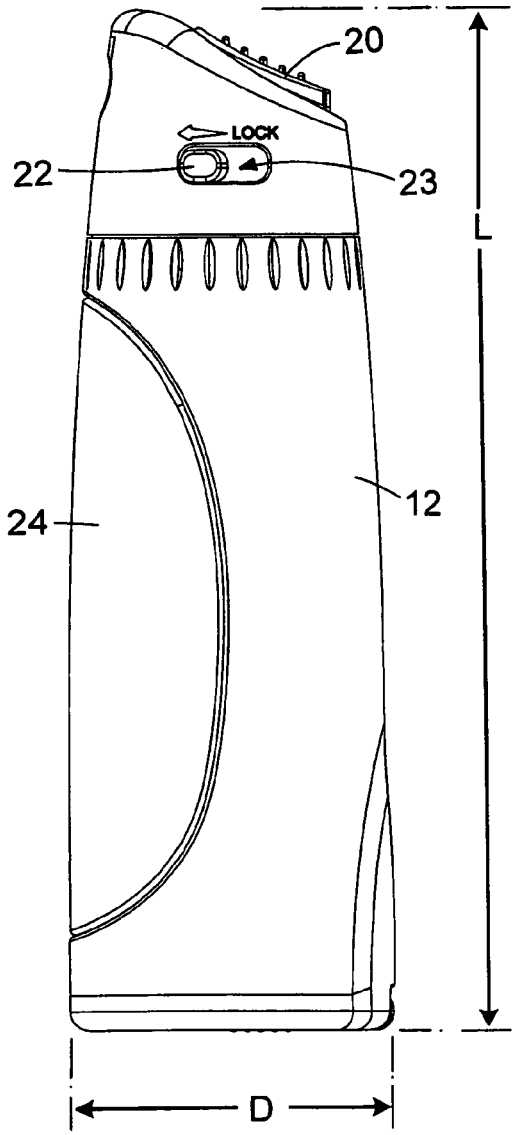
FIG. 3 is a side view of the dispenser.

Referring to FIG. 1, spray dispenser 10 includes a housing 12 having an upper end 11, a lower end 13 and a sidewall 15. Housing 12 defines an interior compartment dimensioned to hold a replaceable aerosol canister 30, shown in FIG. 4 and described below. The housing 12 is small and compact, allowing it to be easily carried by the user in a pocket, briefcase, sportsbag, backpack or handbag, while also being of sufficient size to hold a canister having a desired volume. For example, referring to FIG. 3, the dispenser 10 may have an overall length L of about 5 to 15 cm, preferably about 8 to 12 cm), and a maximum diameter D of about 1.3 to about 4.5 cm), more preferably about 2 to about 4 cm, most preferably about 2.5 to about 3.5 cm. In some implementations, the canister contained within the housing may have a volume of about 0.1 to 5 ounces (about 3 to 150 ml), preferably about 0.5 to 1.5 ounces (about 15 to 45 ml). In a preferred embodiment, the spray dispenser 10 is sized so that its entire length will fit in a user's hand, or in a user's pocket or small handbag. In this embodiment, it is preferred that the length be less than about 12 cm.

Figure 10:
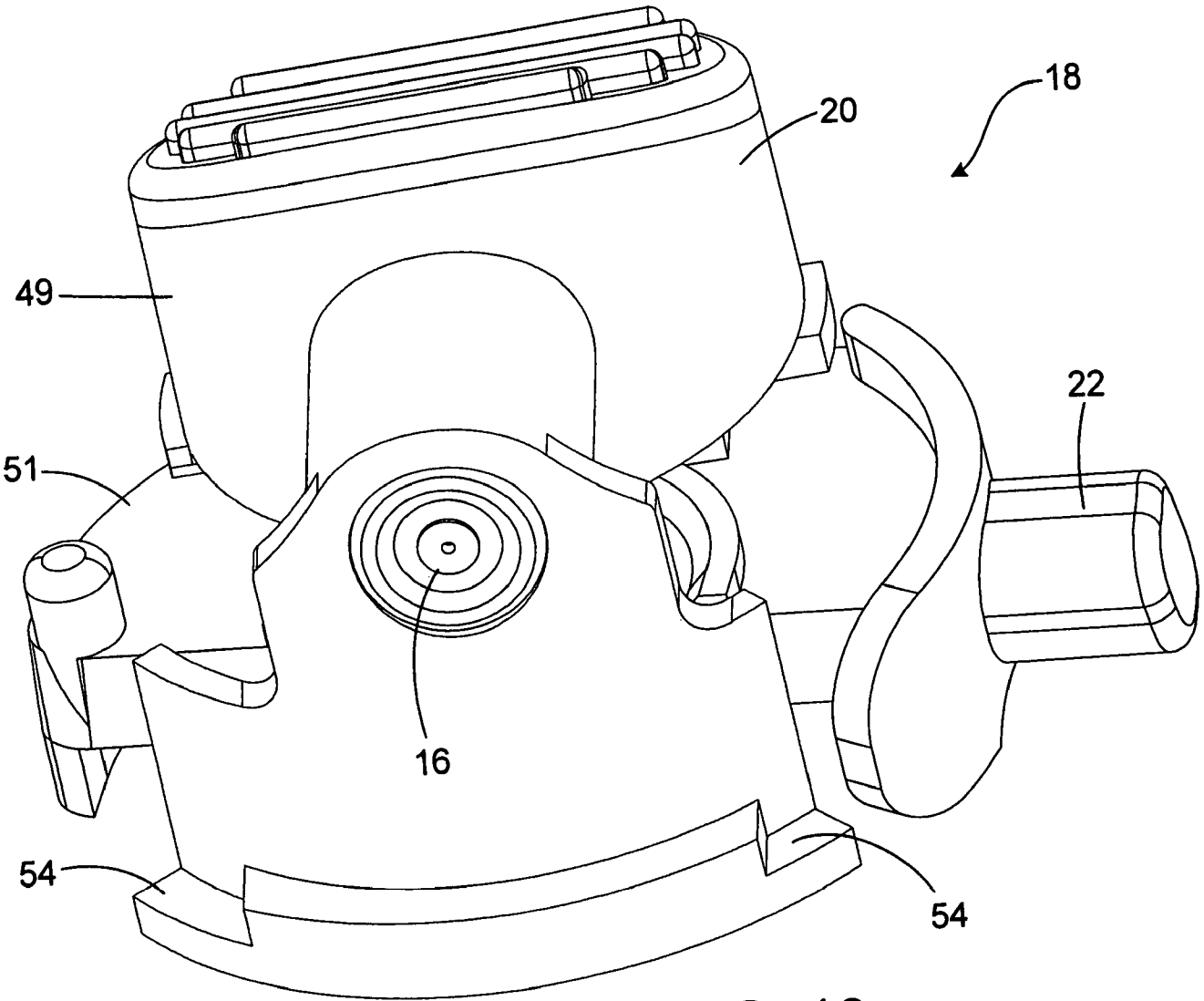
FIG. 10 is an enlarged perspective view of the actuator button and actuator lock (the spray actuator assembly with the outer shell removed).

Housing 12, near the upper end 11 thereof, includes a spray actuator assembly 18 (FIG. 10). Spray actuator assembly 18, which will be discussed in detail below, includes an outer shell 17, a spray nozzle 16, an outlet 14 in outer shell 17 for the spray nozzle, and a manually depressible actuator button 20 exposed at the surface of the dispenser to allow the user to depress the button and deliver a spray of liquid particles from the nozzle. The spray actuator assembly also includes an actuator lock, discussed below, having a handle portion 22 which is exposed, through an elongated opening 23 in the outer shell 17, for manipulation by the user in a radial direction between locked and open positions.

The housing includes a viewing window 27 in sidewall 15 through which a user of the dispenser may view the type of replaceable aerosol canister (described below) that is positioned within the housing. The viewing window may be an open cut-out 29 in the sidewall. The open cut-out may be as little as 5% of the housing sidewall or it may be as large as 90% of the housing sidewall. Preferably the cut-out will be about 10% to about 50% of the housing sidewall. More preferably, the viewing window is a transparent element 24 of the sidewall, as shown in FIGS. 1-4. The transparent element 24 may be the entire housing sidewall (i.e., 100% of the housing sidewall; e.g., where the entire housing sidewall is molded entirely of transparent plastic) or the transparent element may occupy as little as 5% of the housing sidewall. Preferably, the transparent element will be about 10% to about 50% of the housing sidewall. While the transparent element may be molded into the sidewall housing, more typically it will be a separate piece affixed or mounted to a similarly dimensioned cut-out 29. The term transparent is intended to include optical clarity ranging from clear to translucent, provided that the clarity is sufficient to permit a user to visually discern identifiable markings on a canister contained within the spray dispenser. Most preferably, transparent means optical clarity sufficient to enable a user to discern at least 12 point black letters (Times New Roman typeface font) on white paper pressed against the transparent element.

The viewing window is a particularly advantageous feature when the dispenser is part of a product line that includes a plurality (i.e., two or more, preferably three to ten) of replaceable body spray aerosol canisters that have different contents, such as, for example, different fragrances and/or performance or aesthetic characteristics (e.g., deodorant, moisturizing, freshening, earthy, citrus, floral, etc.) and/or different external markings (e.g., words, colors, designs, etc.) on the canisters. Thus, while the viewing window may be any desired size or shape, preferably it should be of sufficient size and shape to enable the user to see external markings (e.g., descriptive or identification markings) on the canister. Typically, the viewing window will have an area (i.e., a projected area) of about 1 $cm^2$ to about 30 $cm^2$, more typically about 3 $cm^2$ to about 25 $cm^2$.

Figure 2:
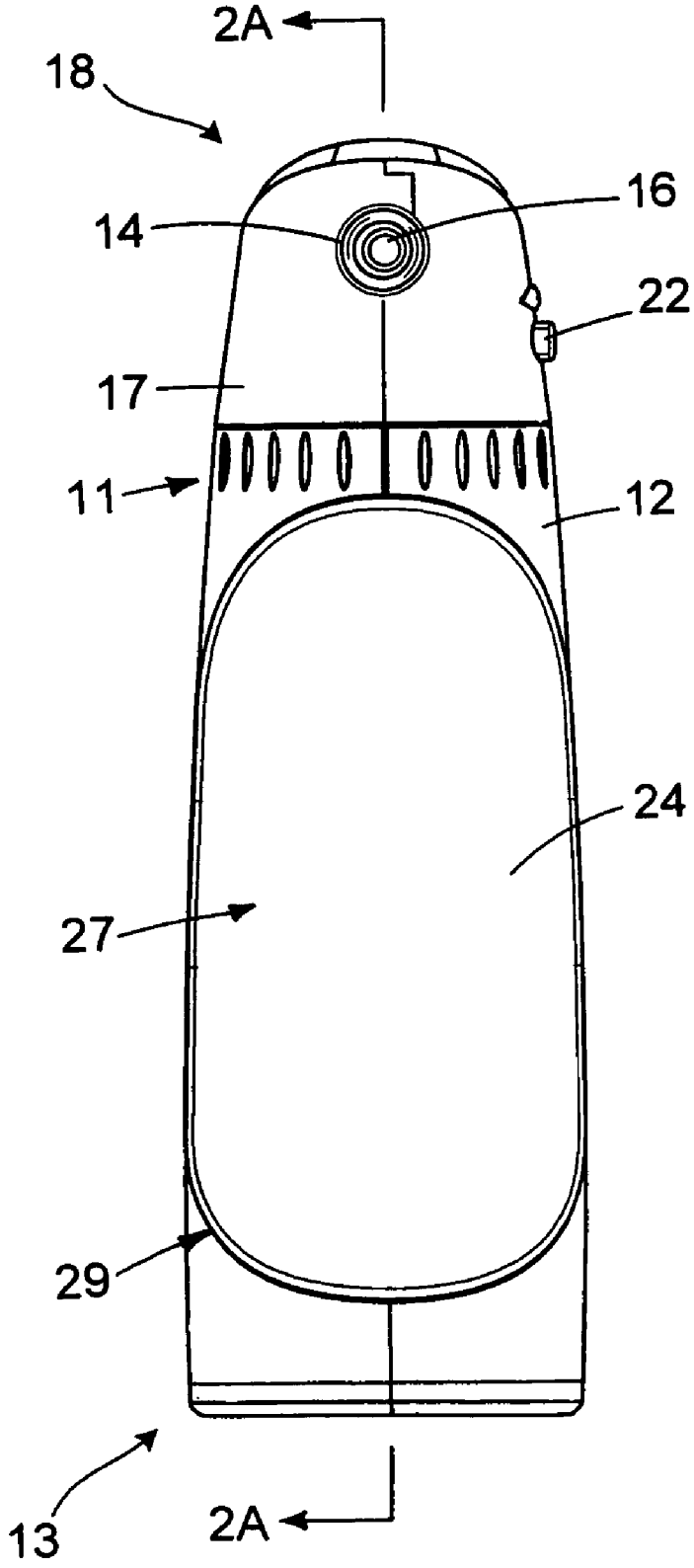
FIG. 2 is a front view of the dispenser of FIG. 1.
Figure 2A:
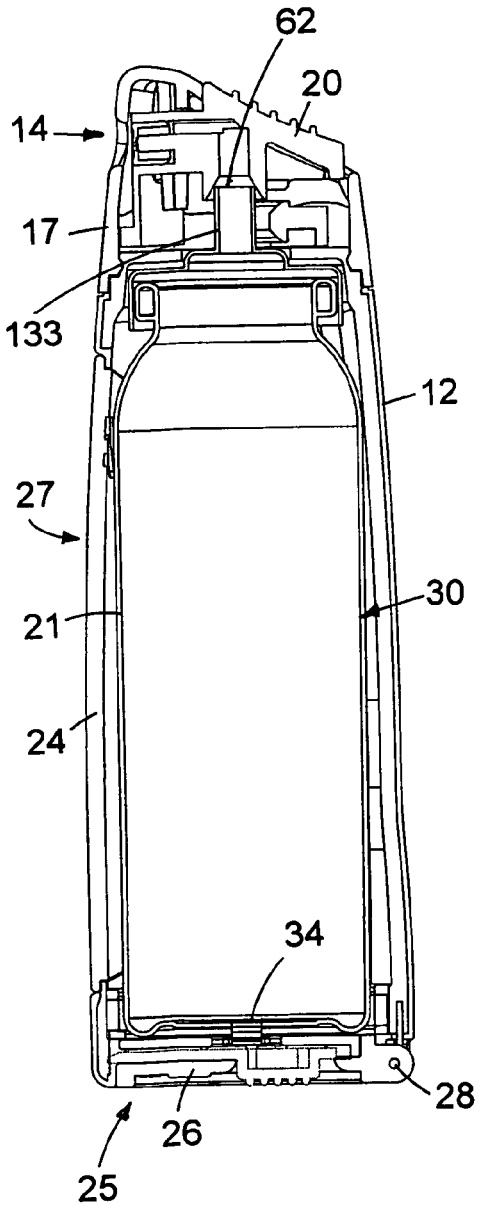
FIG. 2A is a cross-sectional view of the dispenser with a canister in place, taken along line A-A in FIG. 2.
Figure 4:
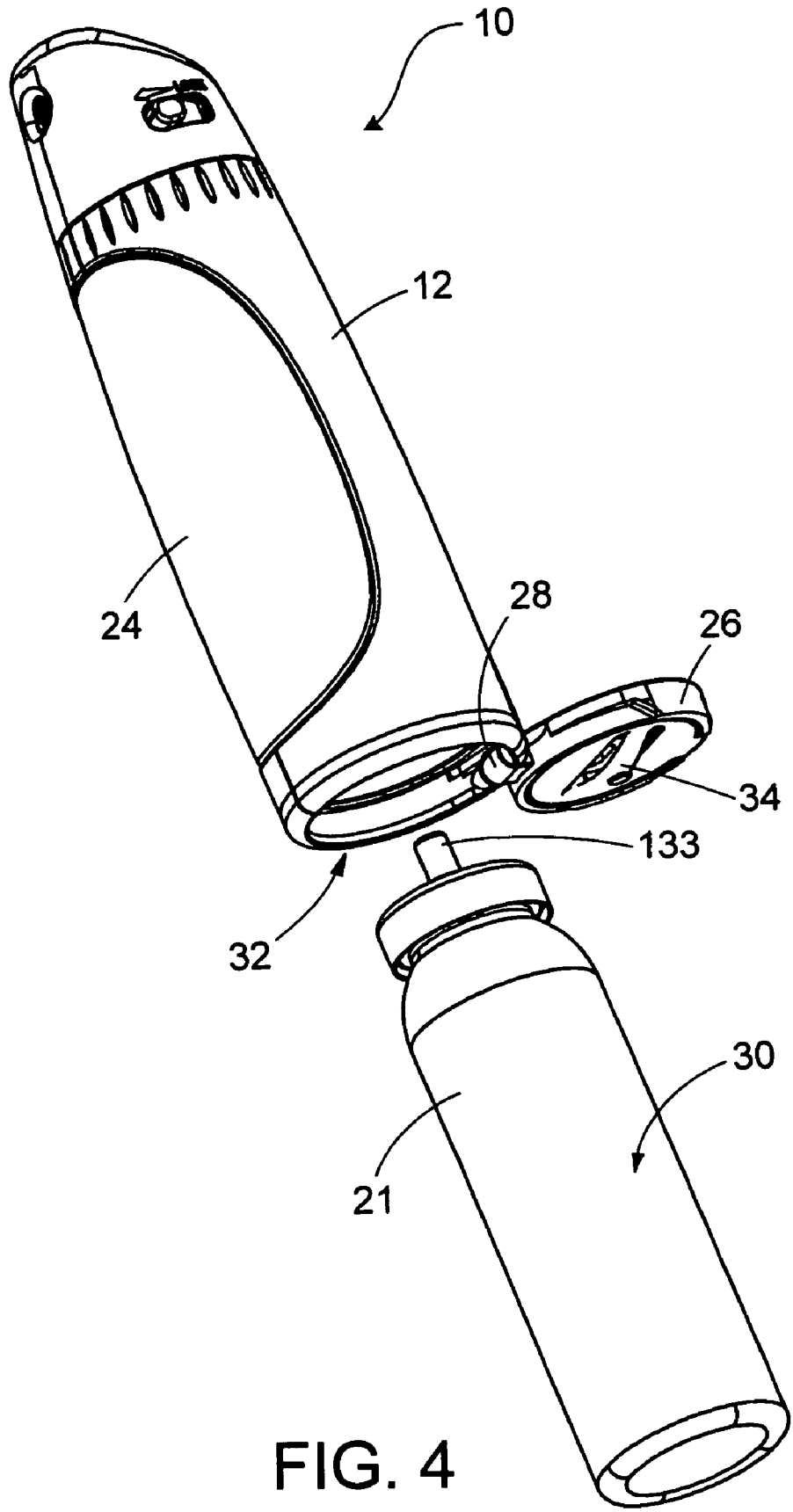
FIG. 4 is a perspective view of the dispenser, showing a canister exploded from the dispenser.

A closure assembly 25 (FIG. 5) is mounted at the lower end 13 of the housing, which closure is adapted to be easily openable by a user to permit the user to easily insert or remove a replaceable aerosol canister 30 through a bottom opening 32 at the bottom end of the housing (see FIGS. 2A and 4). The closure assembly preferably comprises a door 26 mounted to the housing by a hinge 28. The door has an inwardly facing surface 31 (FIG. 5) and an externally facing surface 33 (FIG. 7) (when viewed in the closed position). The door 26 includes a latching mechanism, the operation of which will be discussed below. Because the door is attached to the housing, there is no need for the user to hold the closure assembly in one hand while inserting the canister, as would be the case with a twist-on door. Of course, it is contemplated that the preferred door-type closure described above could be replaced with a different type of closure such as a twist-on cap or press-fit cap, provided that such a cap is equipped with a sufficient retention mechanism to keep it in place during storage and use.

The spray dispenser is used in conjunction with a replaceable body spray aerosol canister 30, including a can 21, a dip tube (not shown), a valve (not shown) and a stem 133. The spray dispenser uses a mechanical break-up feature to achieve a hollow cone pattern with a spread or diameter of about 3.8 to about 6.4 cm measured 15.2 cm from the nozzle. A replaceable aerosol canister (as used herein) does not include a spray nozzle or actuator mechanism. Thus, the replaceable canister will not deliver its contents until inserted into a reusable spray dispenser as described herein.

The replaceable aerosol canister includes a personal care composition. The personal care composition is formulated to be safe for topical application to human skin, and generally is suitable for spraying on clothing without damage to fabrics. The personal care composition may include a wide variety of cosmetic and/or skin care ingredients including, for example, fragrances, deodorant agents, antiperspirant agents, botanicals, vitamins, essential oils, skin conditioning ingredients, and other active and inactive ingredients suitable for topical application to skin. Suitable antiperspirant agents include aluminum salts, such as, for example, aluminum chlorohydrate. A suitable deodorant active is any agent that inhibits, suppresses, masks or neutralizes malodor. These may include (1) antimicrobial or bactericidal agents which kill the bacteria responsible for malodor production, (2) agents which inhibit or suppress or interfere with the bacterial enzymatic pathway that produces malodor, and (3) agents which mask or absorb or neutralize malodor. Fragrances are not considered deodorant active ingredients within the meaning of this application. Examples of deodorant actives include triclosan, triclocarban, usnic acid salts, zinc phenolsulfonate, b-chloro-D-alanine, D-cycloserine, aminooxyacetic acid, cyclodextrin, sodium bicarbonate.

Preferably, the replaceable aerosol canister is part of a system or product line that comprises a plurality (i.e., two or more, preferably three to ten) of replaceable aerosol canisters that have different personal care compositions, such as, for example, different fragrances and/or performance or aesthetic characteristics (e.g., deodorant, moisturizing, freshening, soothing, earthy, citrus, floral, musk, etc.) and/or different external markings (e.g., words, colors, designs, etc.) on the canisters.

Various preferred features of the dispenser 10 will be discussed below.

Leaf Spring

Figure 5:
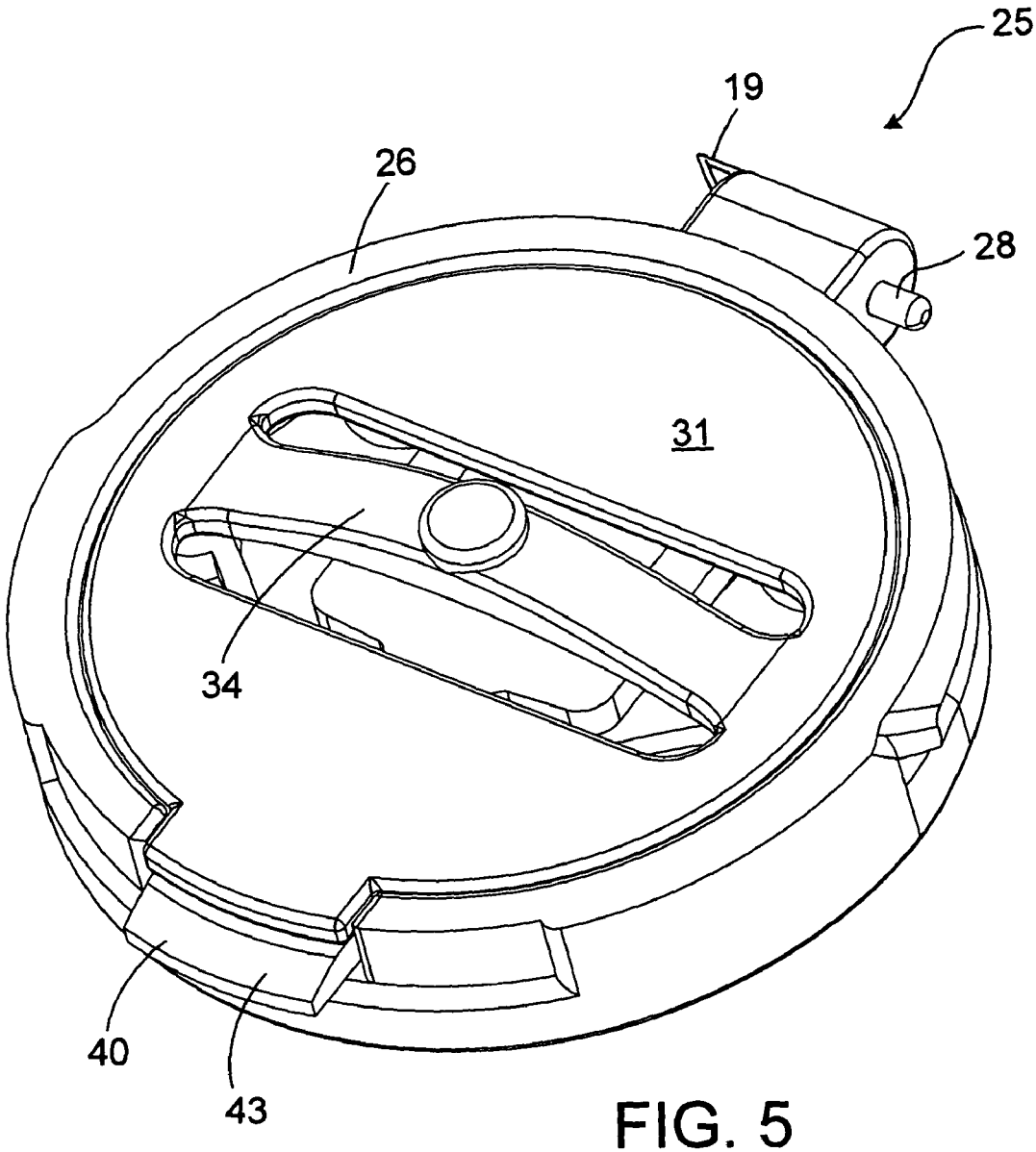
FIG. 5 is an enlarged perspective view of the door of the dispenser.

As shown in FIG. 5, the closure assembly 25 includes a resilient member such as a leaf spring 34, mounted on an internally facing surface 31 of door 26 so that the resilient member is biased (or pressed) against the canister when the canister is inserted and the door is closed, thereby biasing the canister 30 against the actuator assembly 18, limiting movement of the canister during transport and use of the dispenser, and resisting the force created when the user depresses the actuator button. The resilient member also assists in springing open the door 26 when unlatched by the user, as described below. When a leaf spring is used, as shown, the leaf spring may be a plastic molded component that is formed integrally with door 26. The force generated by the resilient member is preferably sufficient to resist the actuation force of the actuator button when it is depressed by a user, which is generally in the range of 2 to 8 pounds (0.9 to 3.6 kg). It is also generally preferred that the force generated by the resilient member be sufficiently low so that the door can be closed relatively easily. For example, in some embodiments it is preferred that the closure force for the door, with a canister in the holder, be less than 5 kg, more preferably about 1 kg to about 3.5 kg. Naturally, of course, the resilient member may include any other suitable type of resilient material such as a resilient plastic or foam piece, coil spring, etc.

Figure 14A:
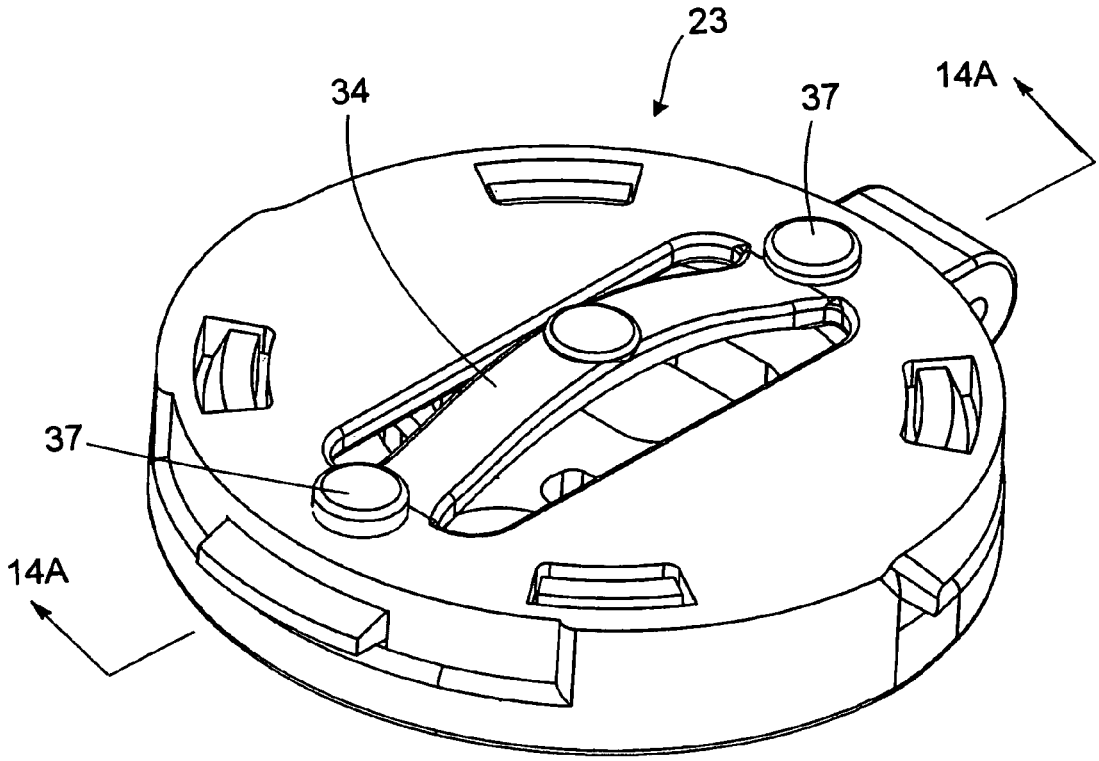
FIG. 14A is a cross-sectional view of the door assembly of FIG. 14, taken along line A-A.
Figure 14B:
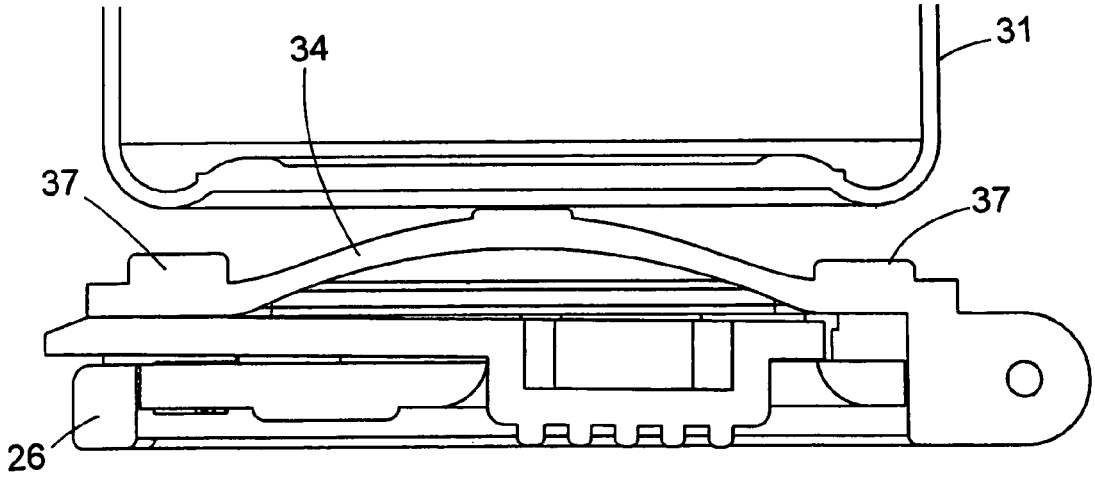
FIG. 14 is a perspective view of an alternative door assembly.

The geometry and physical characteristics of the leaf spring can be selected to provide the spray holder with desired characteristics. For example, making the leaf spring thicker (assuming other factors are kept the same) will tend to make the spring stiffer and thus make the door more difficult to close and reduce the overall deflection of the leaf spring during spray actuation. Conversely, making the leaf spring thinner will tend to reduce the stiffness of the leaf spring, making it easier to close the door and increasing the overall deflection of the leaf spring during spray actuation. If a low door closure force is desired, but it is also desired to prevent full deflection of the leaf spring during spray actuation, positive stops 37 may be provided on the internally-facing surface 31 of the door, e.g., as shown in FIGS. 14 and 14A. When the canister is deflected downwards, it will come to rest on stops 37 prior to the leaf spring bottoming out.

Door Latch Mechanism

Figure 6:
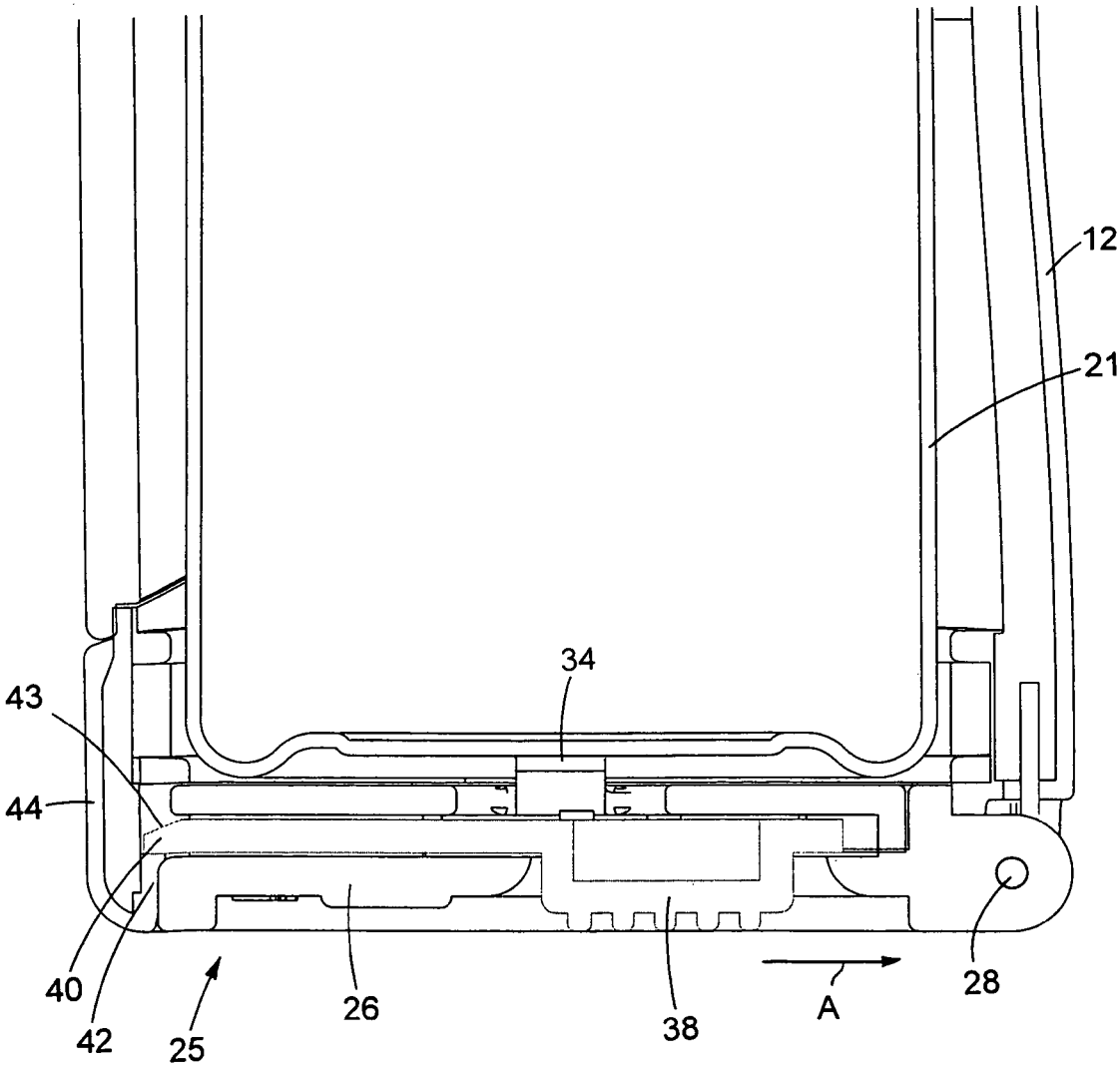
FIG. 6 is an enlarged cross-sectional view of the lower portion of the dispenser.
Figure 7:
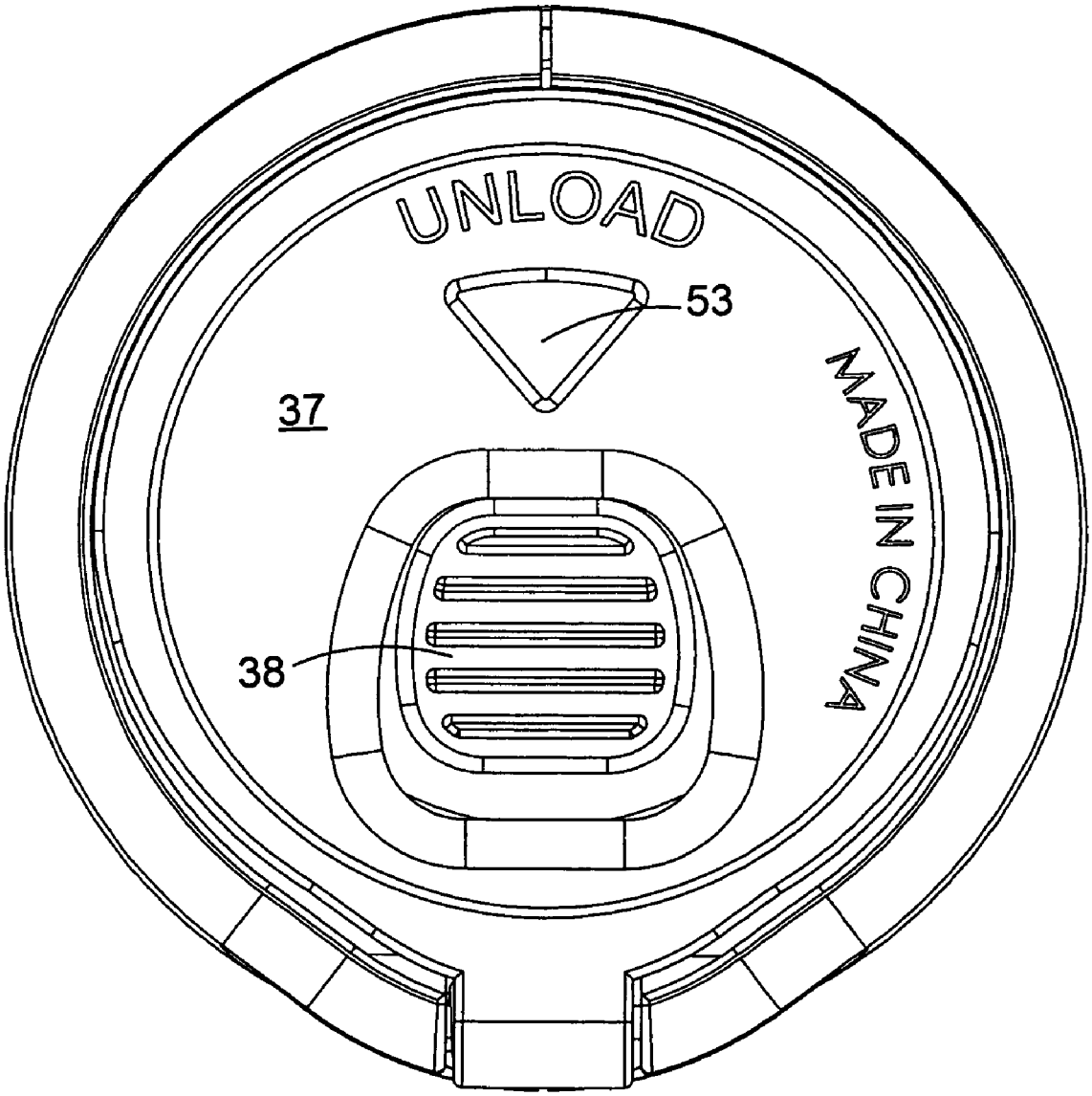
FIG. 7 is an enlarged bottom view of the dispenser.
Figure 8:
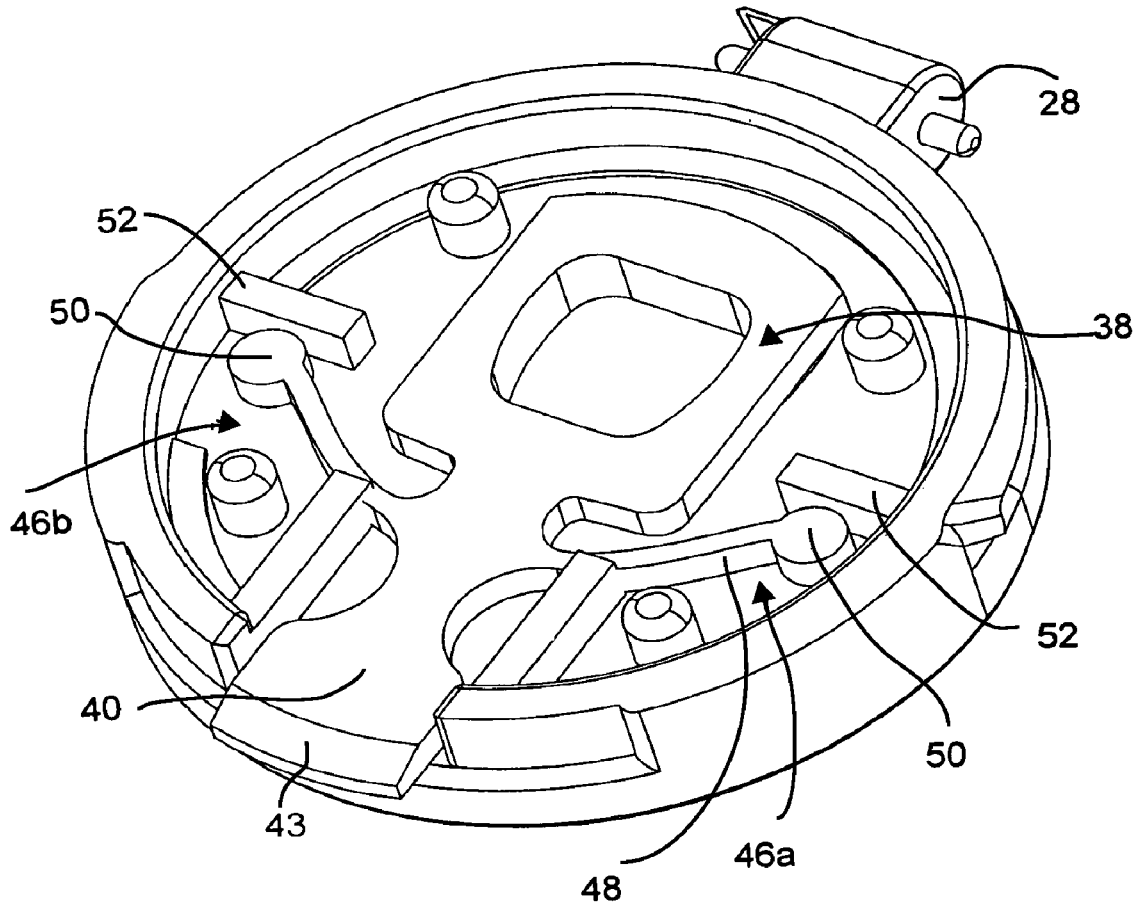
FIG. 8 is an enlarged perspective view of a the door of the dispenser with the leaf spring removed.

The closure assembly 25 includes a latch mechanism that holds the door 26 securely closed and allows the door to be easily opened and closed by a user by operation of a latch actuator 38 (FIGS. 6 and 7). Referring to FIGS. 5 and 6, the latch mechanism includes a latch 40 that moves forward and back in the plane of the door. When the latch is in its extended position, as shown in FIG. 6, it engages a rim 42 of a lower portion 44 of the housing 12, preventing the door from opening. Referring to FIG. 8, latch 40 is biased towards its extended position by integrally formed springs 46*a* and 46*b*. Springs 46*a* and 46*b* include relatively thin curved arms 48, molded into the at-rest extended position, and disc portions 50 which are configured to slide along radially extending planar surfaces 52.

To open the door, the user pushes the latch actuator 38, which is preferably located on an externally facing surface 33 of the door, in the direction of the arrow 53 (FIG. 7), i.e., towards the hinge 28 (arrow A, FIG. 6). This causes the arms 48 to straighten out, sliding the disc portions 50 outwardly along the surfaces 52 and thereby pulling latch 40 to its retracted position. When latch 40 is retracted it no longer engages rim 42 of the housing, allowing the closure assembly 25 to swing open. Opening of the door is aided by the compression force of the leaf spring (if a canister is within the holder), and also by a torsion spring 19 associated with hinge 28.

When the user pushes the door closed, the latch 40 is pushed to its retracted position by the interaction of the rim 42 with the angled top surface 43 of latch 40. The angled surface 43 helps to force the latch into the open position when the door is being closed. The angled surface 43 contacts the rim 42, compressing the springs 46*a* and 46*b* of the latch mechanism and pushing the latch 40 into the closure assembly. As soon as the latch 40 passes the rim 42 it springs back into its normal, extended position, due to the biasing force of springs 46*a* and 46*b*. There is no need for the user to move the latch actuator 38 when closing the door.

Assembling the Closure Assembly

Figure 15:
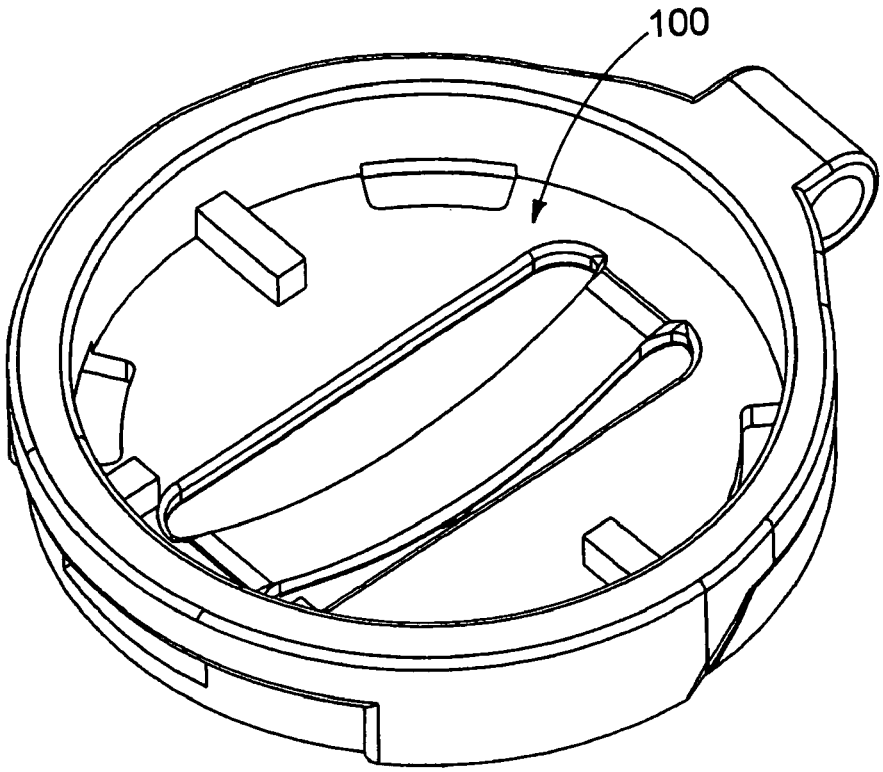
FIGS. 15-15B are perspective views illustrating assembly steps for a closure assembly.
Figure 15A:
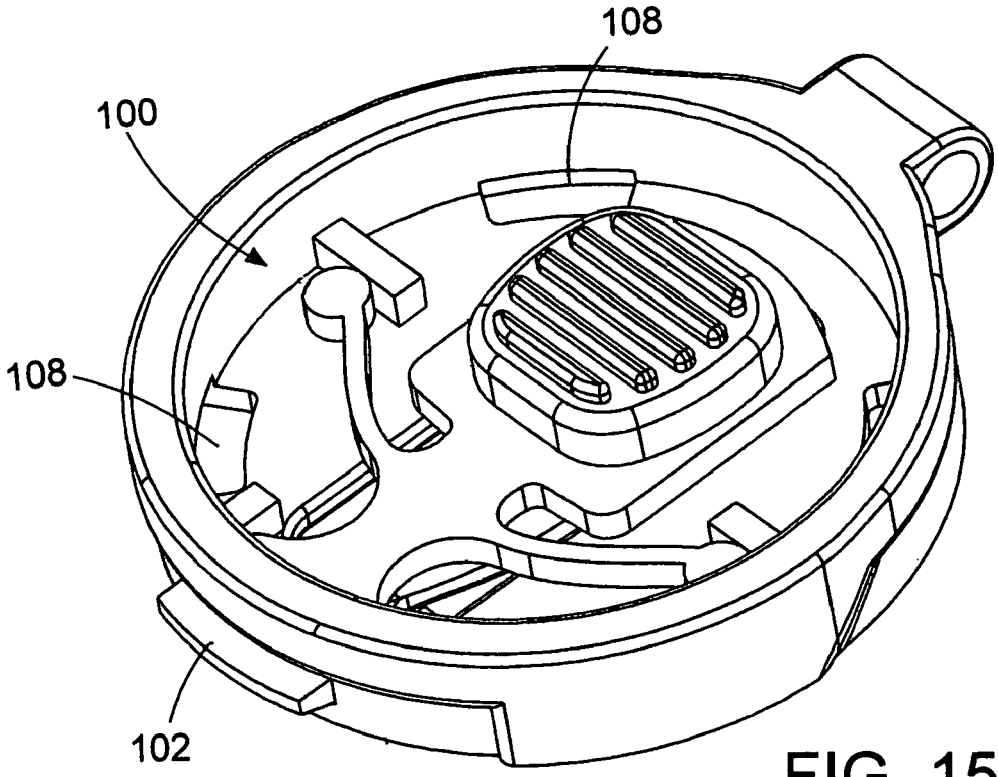
Figure 15B:
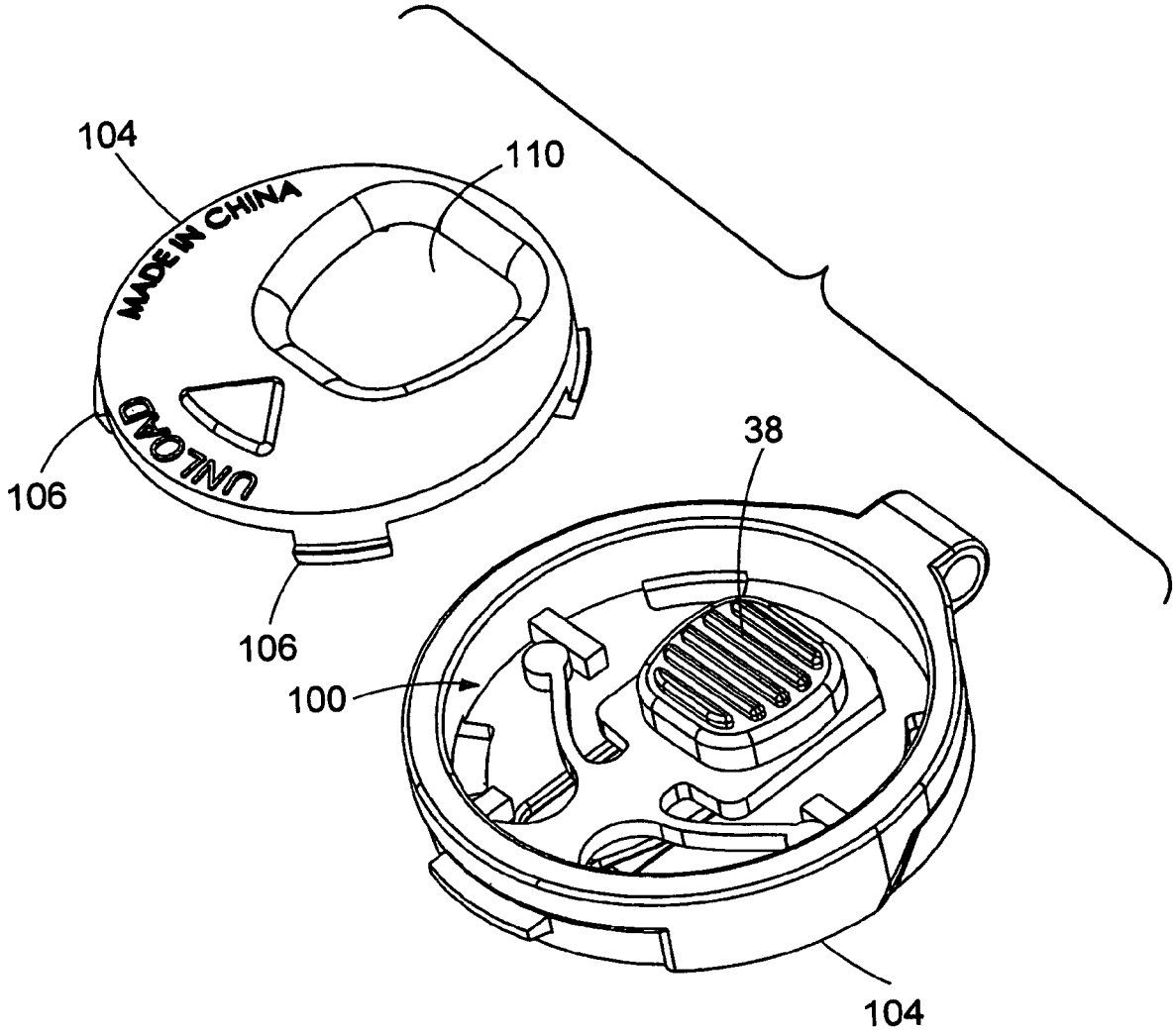

The closure assembly may be manufactured in any desired manner. In some embodiments, the parts of the closure assembly may be snap fit together. For example, the parts may be assembled as illustrated by the series of FIGS. 15-15B, in which a latch portion 102 is first assembled into a door shell 100 which includes the leaf spring (FIGS. 15 and 15A, and then a cover 106 is snap fit into the door shell 100 (FIG. 15B)

by inserting prongs 106 carried by an inward-facing surface 105 of the cover 106 into receiving openings 108 in the door shell 100. Prongs 106 are configured to deflect and spring back upon insertion so that the prongs will be permanently retained in the openings. Cover 106 includes an opening 110 through which the latch actuator 38 extends when the closure assembly is fully assembled.

The closure assembly may be assembled in any other desired manner, for example using adhesives or heat or ultrasonic welding.

Actuator Assembly

Referring to FIG. 10, the spray actuator assembly 18 is shown with the outer shell 18 removed. The spray actuator assembly 18 includes an actuator/nozzle member 49, and a locking member 51. The actuator/nozzle member 49 includes a manually depressible actuator button 20 and a spray nozzle 16, discussed above. Member 49 also defines a pair of notches 54 which are configured to locate and prevent rotational motion of the actuator/nozzle member 49.

Figure 12:
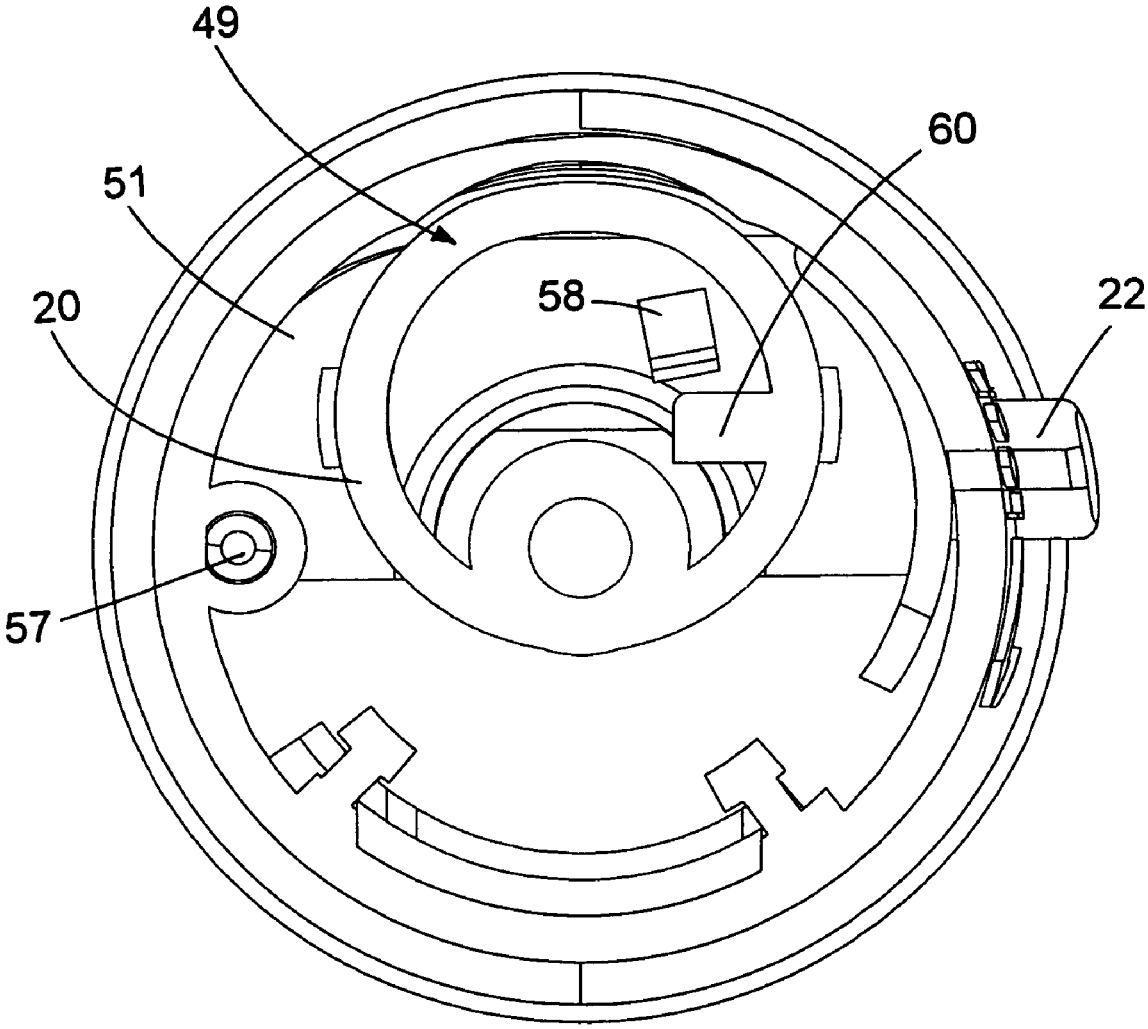
FIG. 12 is a radial cross-sectional view of the assembly shown in FIG. 10, taken through the upper portion of the actuator button, showing the actuator in its unlocked position.

The locking member 51 is mounted to pivot with respect to the actuator/nozzle member 49. The actuator assembly is fixed in the housing 12, with the actuator button 20 protruding outwardly. The pivoting motion of the locking member is in a plane that is generally perpendicular to the long axis of the canister, about a pivot point 57 (FIG. 12). Rotational movement of the locking member is guided by the pivot 57 and an opening 23 in the outer shell 17 of the spray actuator assembly 18.

Figure 9:
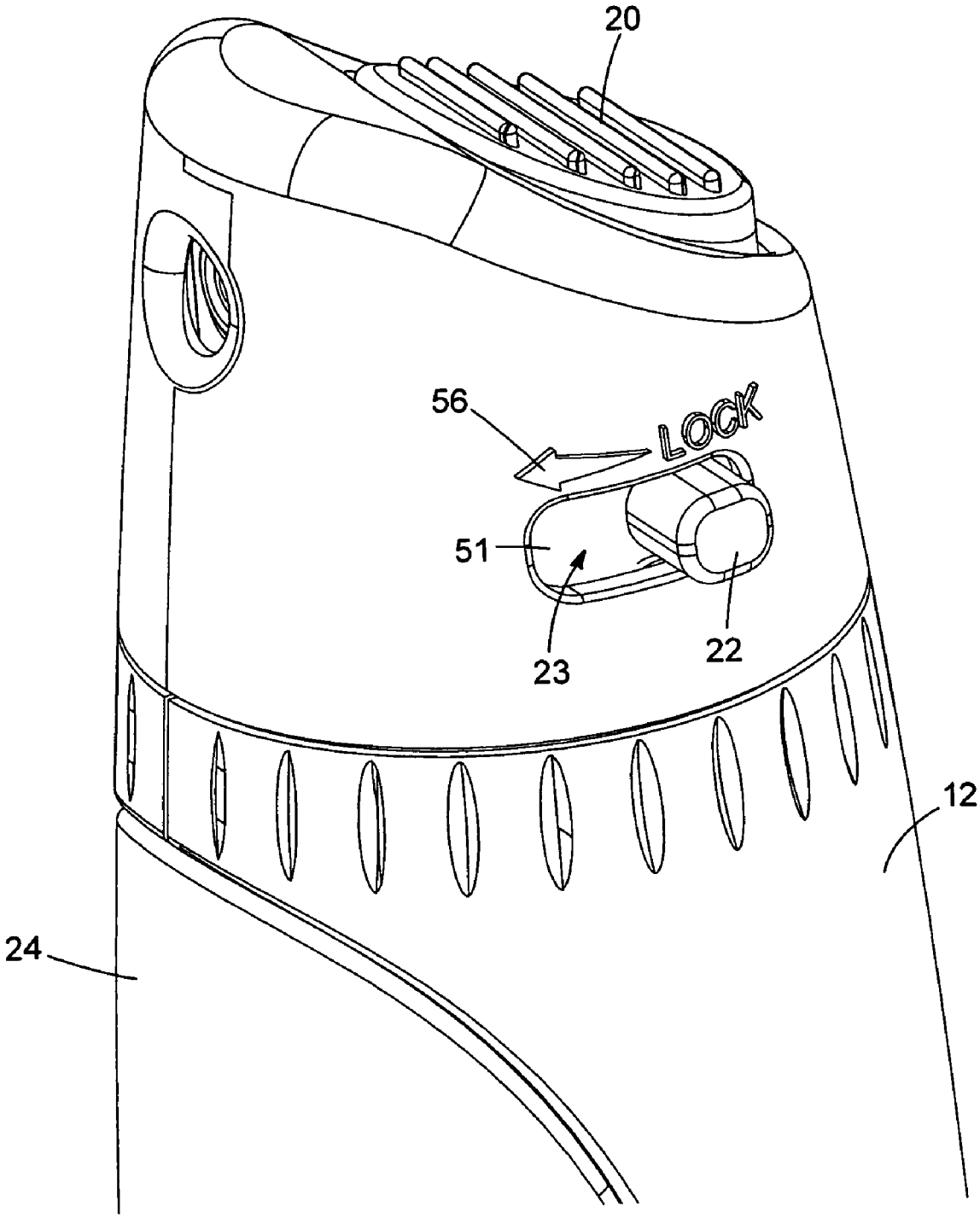
FIG. 9 is an enlarged perspective view of an upper portion of the dispenser.
Figure 11:
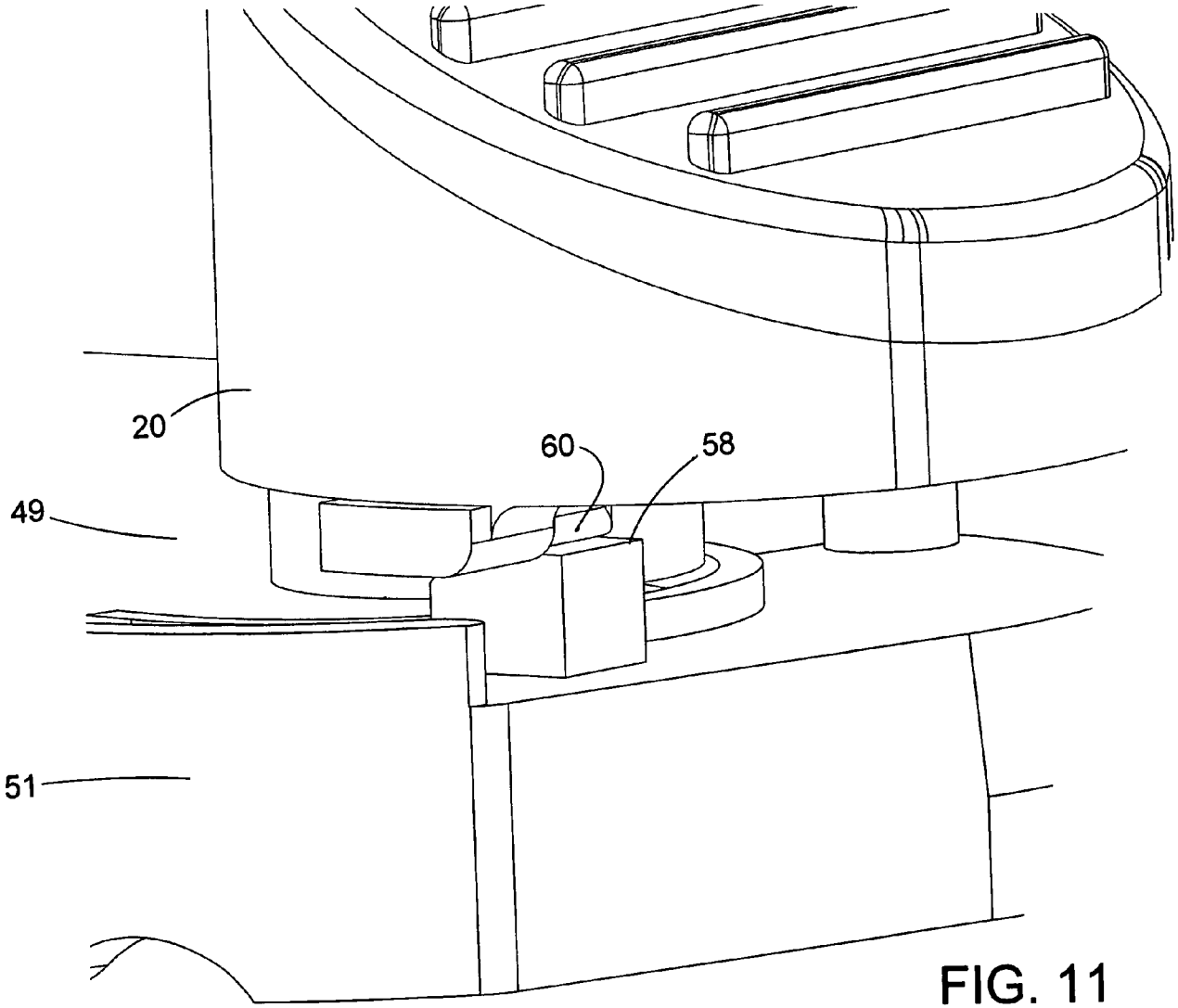
FIG. 11 is a highly enlarged partial perspective view showing engagement of corresponding portions of the actuator lock and actuator button.
Figure 13:
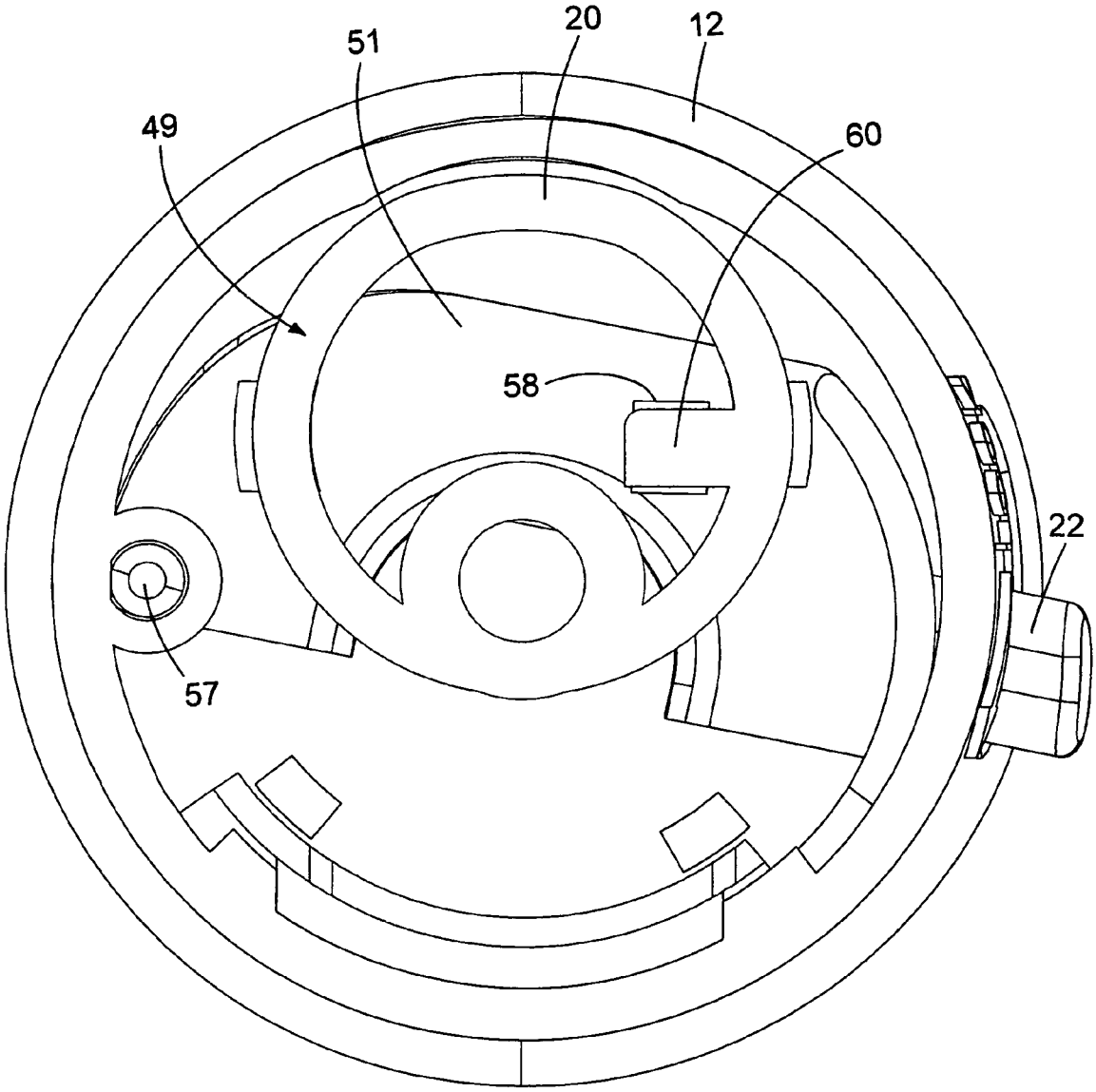
FIG. 13 is similar to FIG. 12, but shows the actuator in its locked position.

The locking member is pivoted by the user moving the handle portion 22, discussed above, back and forth radially. Moving the handle 22 along opening 23 in the direction of arrow 56 (FIG. 9) moves the locking member 51 to the locked position, shown in FIGS. 11 and 13. In this position, a protrusion 58 on the upper surface of the locking member engages a corresponding protrusion 60 on the lower surface of the rim of actuator button 20. This engagement prevents the actuator button 20 from being pressed down, thereby preventing actuation of the spray dispenser. Moving the handle portion in the opposite direction (away from arrow 56) causes the protrusion 58 to move into a hollow region of the actuator button, where it does not engage any corresponding portion of the button. As a result, in this position the actuator is unlocked and the actuator button can be depressed to actuate the spray.

Figure 16:
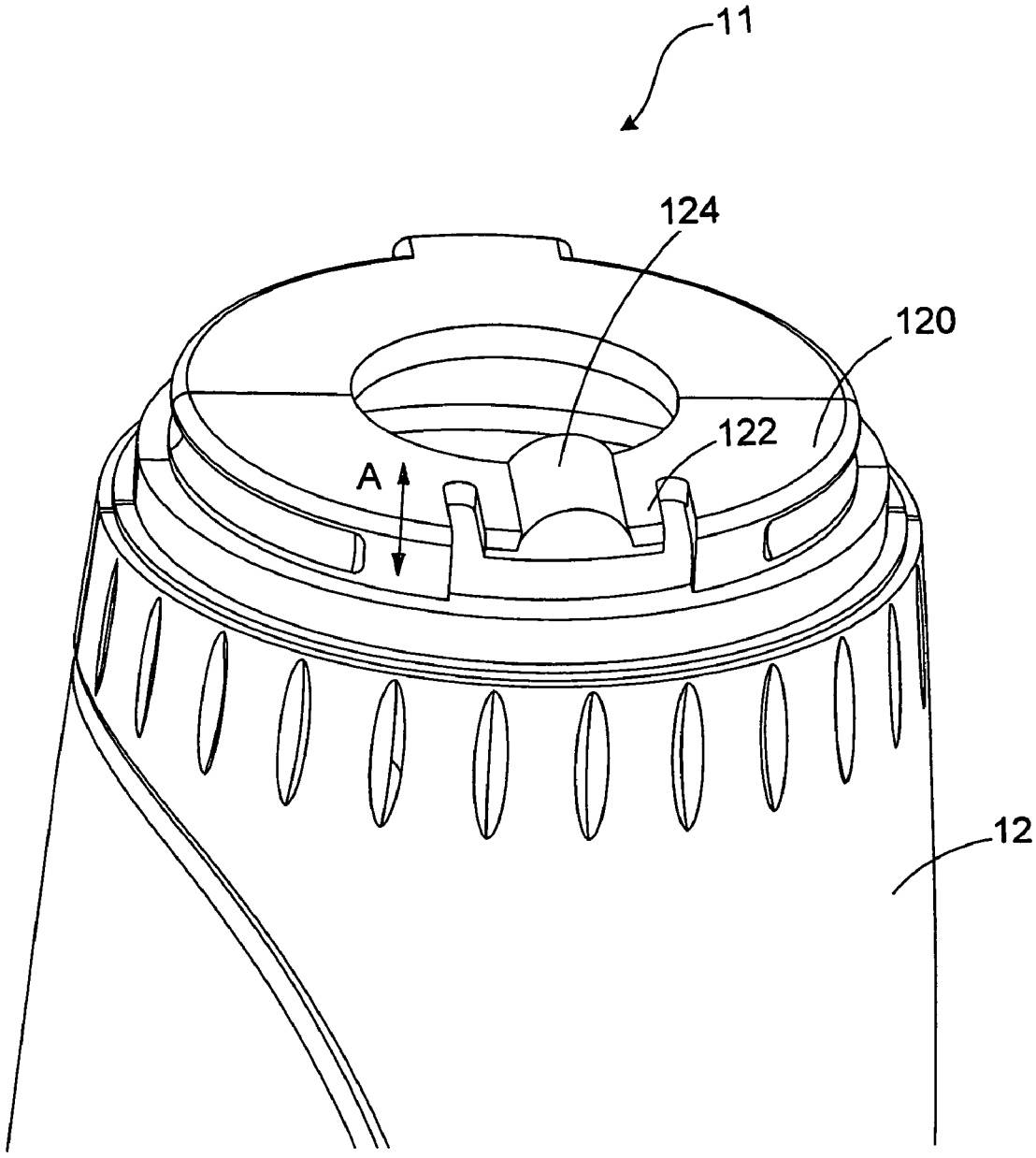
FIG. 16 is a perspective view of the upper portion of an alternative housing.
Figure 17:
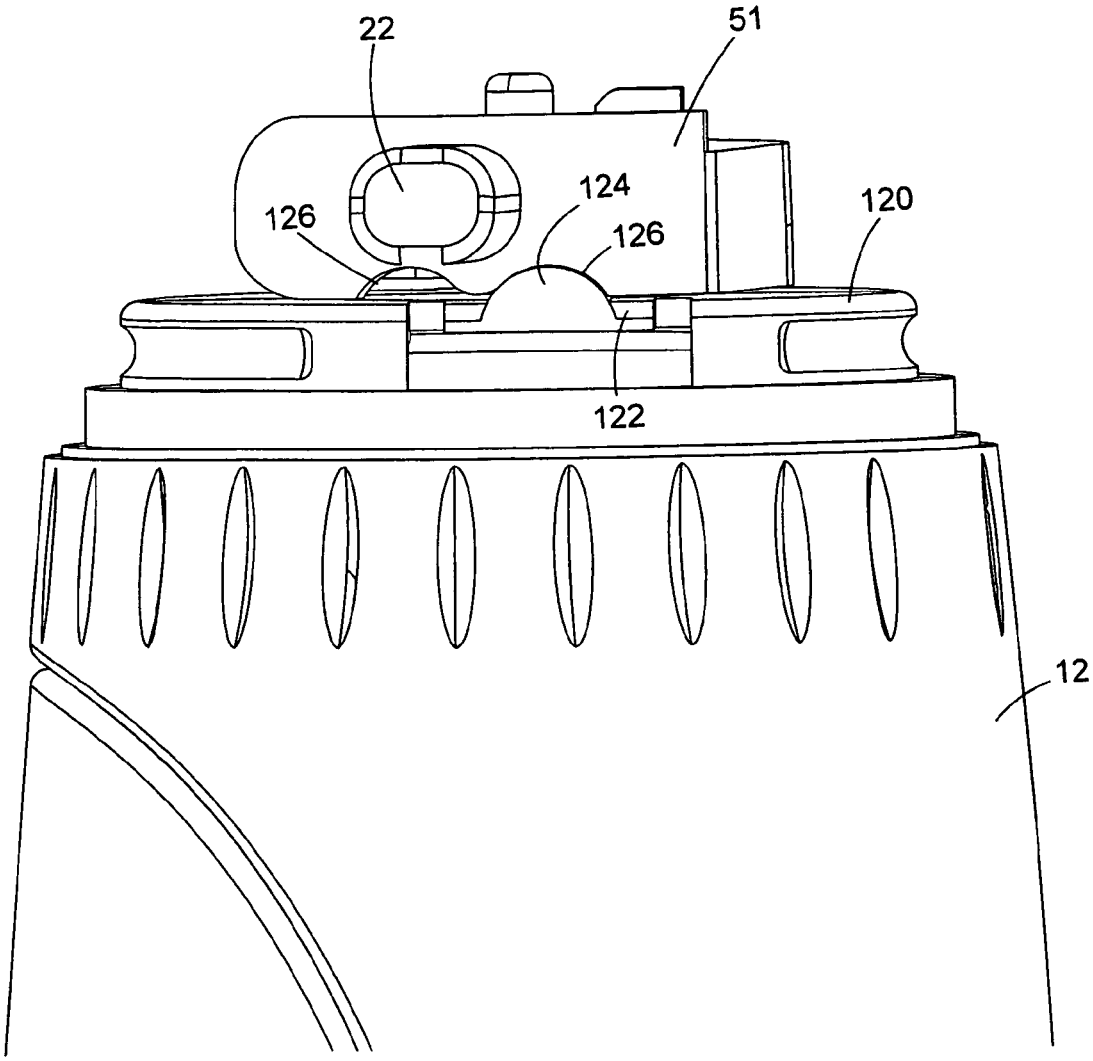
FIGS. 17-17A are front views showing a portion of the actuator lock in two positions relative to the upper portion of the housing shown in FIG. 16.
Figure 17A:
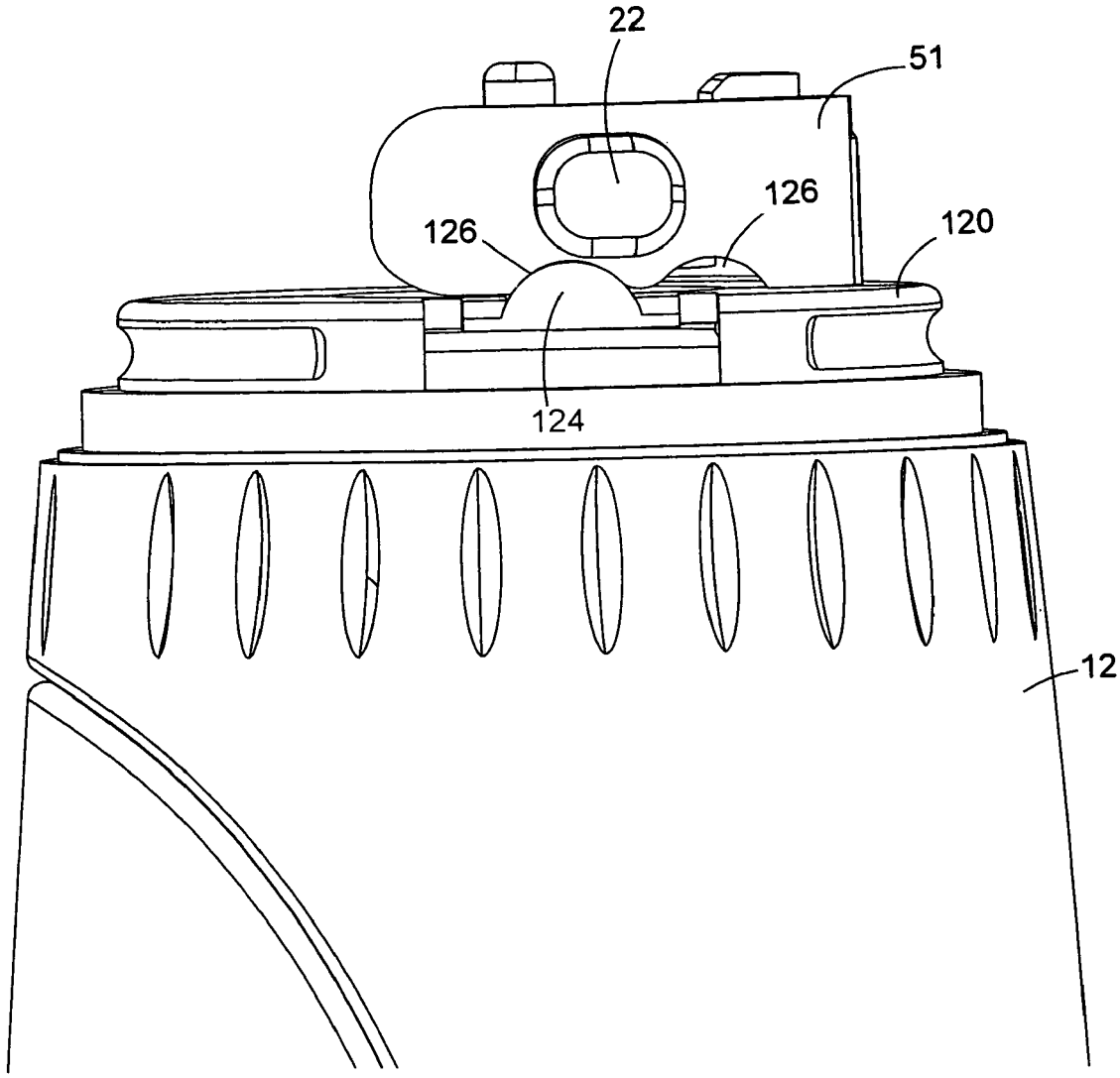

If desired, positive stops may be provided for the two positions of the handle portion 22, to give the user a tactile signal that locking/unlocking has been completed, and to prevent inadvertent locking and unlocking. For example, as shown in FIGS. 16 and 17-17A, the housing 12 may include an upper portion 120, at its upper end 11, that has a flexible tab 122 configured to flex up and down (arrow A). Tab 122 includes a arcuate rib 124 that extends upward, toward locking member 51 of the spray actuator assembly 18 (omitted for clarity in FIG. 16). As shown in FIGS. 17-17A, the locking member 51 includes a pair of arcuate grooves 126, having a radius of curvature that is substantially the same as that of the arcuate rib 124. These grooves are positioned so that when the locking member 51 is in its locked position, the rib 124 engages one of the grooves 126, and when the locking member 51 is in its unlocked position the rib 124 engages the other groove 126. When the handle 22 is moved by the user between the two positions, the camming action of the curved surfaces of the rib and groove causes the tab 122 to deflect downward, releasing the rib from the groove in which it was engaged.

Figure 18:
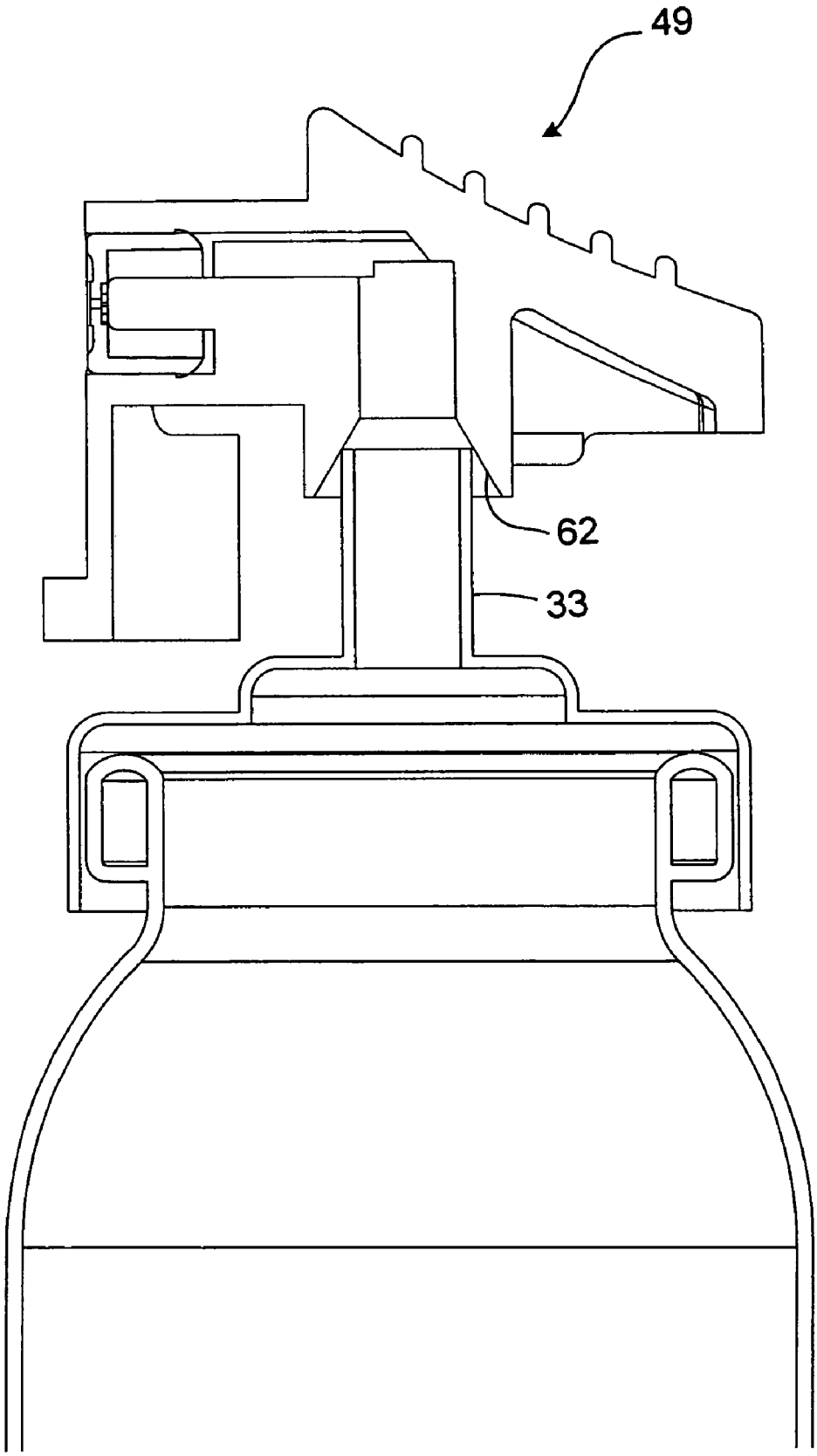
FIGS. 18-18A are enlarged partial cross-sectional views, showing the actuator/nozzle member in contact with the stem of the canister.
Figure 18A:
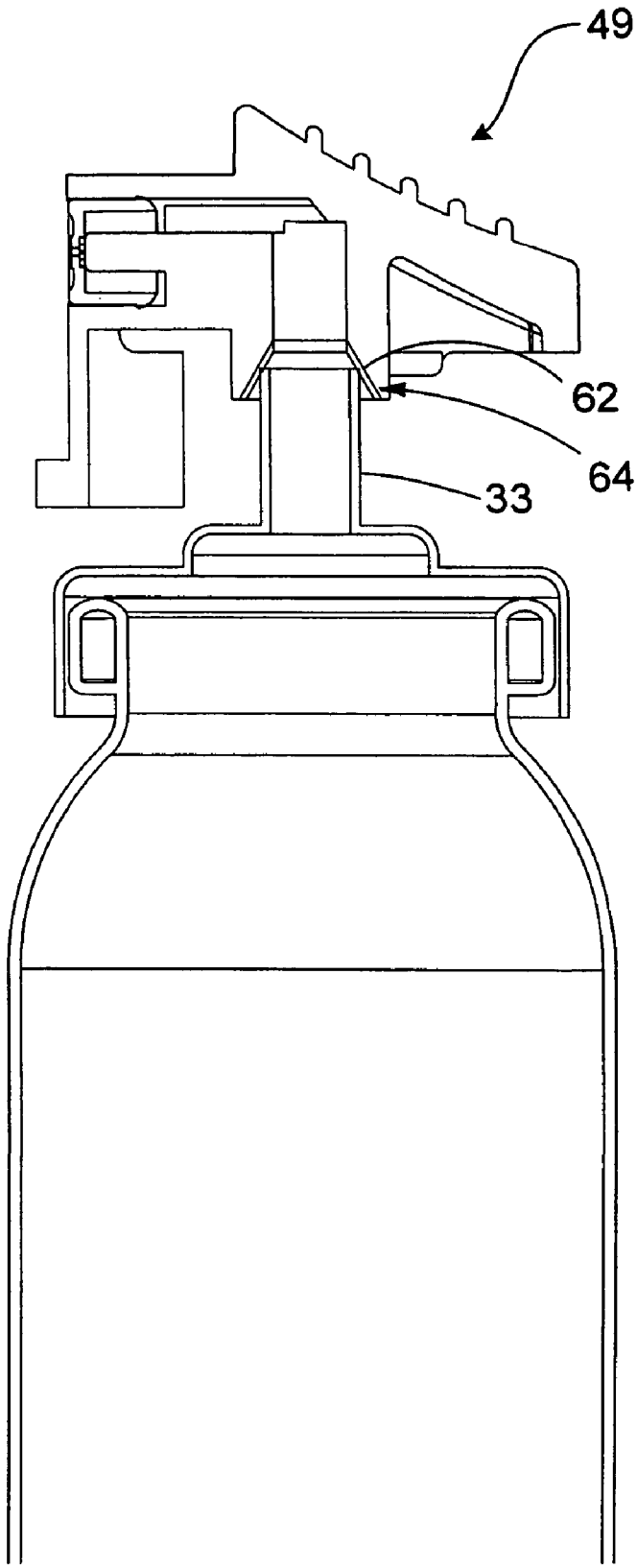

The actuator/nozzle member 49 also includes a lower surface that is configured to engage the stem of the canister. Referring to FIGS. 2A and 18, the lower surface includes a tapered frustro-conical portion 62 that engages the rim of stem 133. This tapered surface provides a good seal with the stem, preventing undesirable leaking of the aerosol composition into the interior of the housing. As shown in FIG. 18A, in some embodiments the frustro-conical portion 62 may include a thin layer of an elastomeric material 64, providing a resilient gasket between the rim of the stem and the lower surface of member 49.

Other Embodiments

A number of embodiments of the invention have been described. Nevertheless, it will be understood that various modifications may be made without departing from the spirit and scope of the invention. For example, the features described herein may be used in any desired combination. For example, the actuator lock and window may be used with other types of doors (e.g., twist-on) or with a disposable dispenser that lacks a door entirely. Accordingly, other embodiments are within the scope of the following claims.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A spray dispenser for an aerosol personal care composition, comprising:

a housing having an upper end, a bottom end and a sidewall, wherein the housing defines an interior compartment for holding a replaceable aerosol canister and has a bottom opening at the bottom end dimensioned to receive the replaceable aerosol canister;

a closure mounted to the bottom opening of the housing, wherein the closure is openable and closable, thereby permitting insertion, retention and removal of the replaceable aerosol canister within or from the housing;

a spray actuator assembly mounted at the upper end of the housing and comprising:

an outer shell comprising an elongated opening extending within a plane that is parallel to the plane of the closure when the closure is in a closed position, a spray nozzle, a manually depressible actuator button comprising an exposed upper surface extending through the outer shell and a lower surface comprising a protrusion, and an actuator locking member comprising:

an exposed handle that is configured to allow a user to move the locking member pivotally within the elongated opening substantially confined to the plane of the elongated opening from locking to unlocking positions, a protrusion on the upper surface of the locking member, wherein, in the locking position, the protrusion on the locking member engages the protrusion of the actuator button, thereby preventing the actuator button from being pressed down, a flexible tab disposed on an upper portion of the upper end of the housing and comprising an arcuate rib extending upwardly; and a pair of arcuate grooves disposed on a lower edge of the locking member and configured such that when the locking member is in its locked position, the arcuate rib engages one of the pair of arcuate grooves, and is further configured such that when the locking member is in its unlocked position, the rib engages the other of the pair of arcuate grooves.

2. The spray dispenser of claim 1 wherein the dispenser has a length of less than about 12 cm.

3. The spray dispenser of claim 1 further comprising a replaceable body spray aerosol canister disposed within the housing.

4. The spray dispenser of claim 1 wherein the spray actuator assembly further includes a frustro-conical surface positioned to engage a stem portion of the aerosol canister.

5. The spray dispenser of claim 1 wherein the locking member is pivotable with respect to the actuator button, and in the locked position interferes with axial movement of the actuator button.

6. The spray dispenser of claim 1 wherein the actuator assembly is fixed in the housing.

7. The spray dispenser of claim 1 further comprising a viewing window in the sidewall of the housing to permit a user to view a marking on the replaceable aerosol canister.

8. The spray dispenser of claim 7 wherein the viewing window comprises a cut-out in the sidewall of the housing to permit a user to view a marking on the replaceable aerosol canister.

9. The spray dispenser of claim 7 wherein the viewing window comprises a transparent element in the sidewall of the housing to permit a user to view a marking on the replaceable aerosol canister.

10. The spray dispenser of claim 1 wherein the spray nozzle is disposed within a recessed outlet of the outer shell.

11. The spray dispenser of claim 1 wherein the closure is mounted to the bottom opening of the housing by a hinge and comprises an internally facing surface and an externally facing surface, the closure being pivotable about the hinge between open and closed positions, thereby permitting insertion, retention and removal of the replaceable aerosol canister within or from the housing

12. The spray dispenser of claim 11 further comprising a latch mechanism configured to maintain the closure in its closed position, the latch mechanism comprising a latch portion configured to engage a region of the housing defining the bottom opening, and a sliding latch actuator positioned on the externally facing surface of the closure and configured to allow a user to move the latch portion out of engagement with the housing by sliding the latch actuator in a direction parallel to the externally facing surface, and a spring mechanism configured to bias the latch portion toward its engaged position.

* * * * *